US008676371B2

(12) United States Patent
Botta

(10) Patent No.: US 8,676,371 B2
(45) Date of Patent: Mar. 18, 2014

(54) ROLLING OF A STRIP IN A ROLLING TRAIN USING THE LAST STAND OF THE ROLLING TRAIN AS A TENSION REDUCER

(75) Inventor: Berthold Botta, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 834 days.

(21) Appl. No.: 12/667,721

(22) PCT Filed: Jul. 1, 2008

(86) PCT No.: PCT/EP2008/058444

§ 371 (c)(1),
(2), (4) Date: Jan. 5, 2010

(87) PCT Pub. No.: WO2009/004005

PCT Pub. Date: Jan. 8, 2009

(65) Prior Publication Data

US 2010/0193623 A1 Aug. 5, 2010

(30) Foreign Application Priority Data

Jul. 5, 2007 (DE) ..... 10 2007 031 333

(51) Int. Cl.
*G06F 19/00* (2011.01)

(52) U.S. Cl.
USPC ..... 700/152; 700/154; 700/155; 700/156; 700/148; 700/150; 72/86; 72/6.1; 72/14.8; 72/151; 72/241.2; 72/202; 72/10.3; 72/42; 72/6.2; 72/9.1; 242/418

(58) Field of Classification Search
USPC ..... 700/152; 242/418; 72/241.2
See application file for complete search history.

(56) References Cited

U.S. PATENT DOCUMENTS 3,592,030 A * 7/1971 Smith, Jr. ..... 72/10.4
3,808,858 A * 5/1974 Connors et al. ..... 72/10.4

(Continued)

FOREIGN PATENT DOCUMENTS

DE 4243045 7/1993 ..... B21B 37/00
JP 58103905 6/1983 ..... B21B 37/00

(Continued)

OTHER PUBLICATIONS

Bilkhu, "Dynamic Control of tension, Thickness and Flatness for a tandem Cold Mill", Oct. 2001, pp. 49-54.*

(Continued)

*Primary Examiner* — Kavita Padmanabhan
*Assistant Examiner* — Olvin Lopez Alvarez
(74) *Attorney, Agent, or Firm* — King & Spalding L.L.P.

(57) ABSTRACT

A rolling train for rolling a strip has a number of rolling stands and a coiler. The rolling stands have work and backing rolls. Data of the strip are fed to a control device of the rolling train which determines individual pass reductions for the rolling stands based on the data. It controls the main rolling stands and the coiler such that the strip is rolled in the main rolling stands according to the individual pass reductions and then coiled up. It determines the individual pass reductions such that they are zero and controls the rolling stand arranged directly upstream of the coiler such that—with respect to this main rolling stand—the tension in the strip on the outlet side is less than on the inlet side, but the strip runs through this rolling stand without undergoing any forming, at least on one side.

14 Claims, 2 Drawing Sheets

(56) References Cited

U.S. PATENT DOCUMENTS

| | | | | |
|---|---|---|---|---|
| 4,805,492 | A * | 2/1989 | Tsuruda | 72/9.1 |
| 5,012,660 | A * | 5/1991 | Peterson et al. | 72/10.4 |
| 5,495,735 | A * | 3/1996 | Nishimura | 72/8.2 |
| 5,524,465 | A * | 6/1996 | Kajiwara et al. | 72/42 |
| 5,609,053 | A | 3/1997 | Ferreira et al. | 72/9.2 |
| 5,619,880 | A * | 4/1997 | Polster et al. | 72/11.4 |
| 5,634,257 | A * | 6/1997 | Kajiwara et al. | 29/527.7 |
| 5,860,304 | A * | 1/1999 | Anbe et al. | 72/9.1 |
| 5,964,116 | A * | 10/1999 | Bode et al. | 72/247 |
| 6,030,470 | A * | 2/2000 | Hensger et al. | 148/541 |
| 6,076,388 | A * | 6/2000 | Kajiwara et al. | 72/236 |
| 6,148,653 | A * | 11/2000 | Sako et al. | 72/8.8 |
| 6,158,260 | A * | 12/2000 | Ginzburg | 72/9.1 |
| 6,240,756 | B1 * | 6/2001 | Tsugeno | 72/8.1 |
| 6,282,938 | B1 * | 9/2001 | Mertens et al. | 72/202 |
| 6,619,092 | B2 * | 9/2003 | Nakayama et al. | 72/234 |
| 7,031,797 | B2 * | 4/2006 | Reinschke et al. | 700/150 |
| 7,086,260 | B2 * | 8/2006 | Abi-Karam | 72/10.2 |
| 7,481,089 | B2 * | 1/2009 | Valence et al. | 72/238 |
| 7,980,109 | B2 * | 7/2011 | Perret | 72/229 |
| 8,210,015 | B2 * | 7/2012 | Kneppe et al. | 72/247 |
| 8,490,447 | B2 * | 7/2013 | Kurz et al. | 72/8.1 |
| 2003/0015010 | A1 * | 1/2003 | Kobayashi et al. | 72/8.9 |
| 2009/0277241 | A1 * | 11/2009 | Jonsson | 72/9.2 |
| 2009/0314873 | A1 * | 12/2009 | Schmid | 242/534 |
| 2010/0050727 | A1 * | 3/2010 | Botta | 72/205 |
| 2010/0218576 | A1 * | 9/2010 | Felkl | 72/6.2 |

FOREIGN PATENT DOCUMENTS

| | | | |
|---|---|---|---|
| JP | 60099421 | 6/1985 | B21B 37/12 |
| JP | 3146202 | 6/1991 | B21B 1/28 |
| RU | 2189876 C2 | 9/2002 | B21B 37/48 |
| WO | 9951368 | 10/1999 | B21B 1/32 |

OTHER PUBLICATIONS

Rhodes, "Pinch Rolls", Apr. 5, 2004, pp. 11.*

International Search Report for Application No. PCT/EP2008/058444 (11 pages), Sep. 22, 2008.

German Office Action for Application No. 10 2007 031 333.2 (4 pages), Mar. 28, 2008.

* cited by examiner

ROLLING OF A STRIP IN A ROLLING TRAIN USING THE LAST STAND OF THE ROLLING TRAIN AS A TENSION REDUCER

CROSS-REFERENCE TO RELATED APPLICATIONS

This application is a U.S. National Stage Application of International Application No. PCT/EP2008/058444 filed Jul. 1, 2008, which designates the United States of America, and claims priority to German Application No. 10 2007 031 333.2 filed Jul. 5, 2007, the contents of which are hereby incorporated by reference in their entirety.

TECHNICAL FIELD

The present invention relates to an operating method for a rolling train for the rolling of a strip, in particular a metal strip,

- the rolling train having a number of main rolling stands and a coiler arranged downstream of the main rolling stands,
- the main rolling stands respectively having work rolls and at least backing rolls,
- data of the strip, which establish at least an overall pass reduction other than zero by which an initial thickness of the strip is to be reduced in the rolling train, being fed to a control device of the rolling train,
- the control device determining individual pass reductions for the main rolling stands on the basis of the data fed to it
- the control device controlling the main rolling stands and the coiler in such a way that the strip is rolled in the main rolling stands in a way corresponding to the individual pass reductions determined and is then coiled up by the coiler.

The present invention also relates to a control program for a rolling train of the type described above, the control program comprising machine code which, when executed by the control device, has the effect that the control device operates the rolling train according to an operating method of the above type.

Furthermore, the present invention relates to a data carrier on which such a control program is stored in a machine-readable form.

Furthermore, the present invention relates to a control device for a rolling train of the type described above, the control device being formed in such a way that it operates the rolling train according to an operating method of the type described above.

Finally, the present invention relates to a rolling train with a number of main rolling stands, a coiler arranged downstream of the main rolling stands and a control device, the main rolling stands respectively having work rolls and backing rolls and the control device being formed in such a way that it operates the rolling train according to an operating method of the type described above.

BACKGROUND

The items described above are generally known.

The main rolling stands are generally four-high or six-high stands. This is also the principal configuration within the scope of the present invention. However, other configurations are also possible. The only exclusion applies to purely two-high stands, which have no rolls other than the work rolls.

WO 99/51368 A1 discloses a Steckel rolling mill, which has two rolling stands, upstream of which there is a coiling furnace and downstream of which there is a further coiling furnace. Each of the rolling stands is formed as a four-high stand. To set the temperature of the coiled strip, the strip is re-coiled with as little pass reduction as possible—as far as possible with a pass reduction of zero.

DE 42 43 045 A1 discloses the setting of a controlled strip tension between the rolling stands of a rolling train themselves and between the rolling stands and the coilers.

When rolling strips together with subsequent coiling, in some cases it is intended for the tension upstream of the coiler to be as low as possible, since otherwise there is the risk of the individual layers of the coiled-up coil sticking to one another. Upstream and downstream of the last rolling stand in which the strip is rolled (i.e. reduced in thickness), on the other hand, the strip is intended to have a tension for reasons concerning technical aspects of rolling.

Various measures are known in the prior art for isolating the tension in the strip upstream of the coiler and the tension in the strip downstream of the last main rolling stand in which the strip is rolled.

One known measure, for example, comprises providing a tension bridle between the last main rolling stand in which the strip is rolled and the coiler. A further known measure, for example, comprises providing a driver instead of the tension bridle. In individual instances, the driver may also be formed as a two-high stand, the strip not being rolled but only driven in the two-high stand.

The aforementioned known measures can be realized very easily if a rolling train is being newly constructed. In the case of existing rolling trains, on the other hand,—in particular for reasons of space—the measures can only be realized with difficulty, by undertaking major conversion work (including the associated costs) or not at all.

SUMMARY

According to various embodiments, items can be provided on the basis of which isolation of the tension in the strip upstream of the coiler and the tension with which the strip runs out from the last main rolling stand in which the strip is rolled can be achieved. It is intended here that—at least in principle—the isolation can also be realized in the case of existing installations in which the known measures of the prior art cannot be realized.

According to an embodiment, in an operating method for a rolling train for the rolling of a strip, in particular a metal strip, the rolling train having a number of main rolling stands and a coiler arranged downstream of the main rolling stands, the main rolling stands respectively having work rolls and at least backing rolls, data of the strip, which establish at least an overall pass reduction other than zero by which an initial thickness of the strip is to be reduced in the rolling train, being fed to a control device of the rolling train, the control device determining individual pass reductions for the main rolling stands on the basis of the data fed to it, the control device controlling the main rolling stands and the coiler in such a way that the strip is rolled in the main rolling stands in a way corresponding to the individual pass reductions determined and is then coiled up by the coiler, wherein the control device determines the individual pass reductions in such a way that the individual pass reduction of the main rolling stand arranged directly upstream of the coiler is zero, and wherein the control device controls the main rolling stand arranged directly upstream of the coiler in such a way that—with respect to this main rolling stand—the tension on the outlet side is less than the tension on the inlet side, but the strip runs through this main rolling stand without undergoing forming, at least on one side.

According to a further embodiment, the strip can be a narrow strip. According to a further embodiment, the strip may have a wedge profile before the rolling in the rolling train. According to a further embodiment, the control device may activate the main rolling stand arranged directly upstream of the coiler in such a way that the strip runs through this main rolling stand without undergoing forming over its entire width. According to a further embodiment, at least at the beginning of the rolling of the strip, the control device may activate the main rolling stand arranged directly upstream of the coiler in such a way that at least the work rolls of this main rolling stand are pivoted with respect to one another, as seen in the strip running direction, and/or are set in a wedge profile, as seen in the strip thickness direction, in such a way that the strip runs out straight from this main rolling stand.

According to a further embodiment, the strip can be cold-rolled in the rolling train. According to a further embodiment, the number of main rolling may stand is at least four. According to a further embodiment, the control device may control the main rolling stand arranged directly upstream of the coiler in such a way as to regulate the rolling force and in that the control device determines a desired rolling force of this main rolling stand in such a way that the strip runs through this main rolling stand without undergoing forming.

According to another embodiment, in a control program for a control device of a rolling train, the rolling train having a number of main rolling stands and a coiler arranged downstream of the main rolling stands and the main rolling stands respectively having work rolls and at least backing rolls, the control program comprises machine code which, when executed by the control device, has the effect that the control device operates the rolling train according to an operating method as described above.

According to yet another embodiment, a data carrier stores a control program as described above in a machine-readable form.

According to yet another embodiment, a control device for a rolling train, the rolling train having a number of main rolling stands and a coiler arranged downstream of the main rolling stands and the main rolling stands respectively having work rolls and at least backing rolls, the control device being formed in such a way that it operates the rolling train according to an operating method as described above.

According to yet another embodiment, a rolling train has a number of main rolling stands arranged downstream of the main rolling stands and a control device as described above, the main rolling stands respectively having work rolls and at least backing rolls.

BRIEF DESCRIPTION OF THE DRAWINGS

Further advantages and details emerge from the following description of exemplary embodiments in conjunction with the basic drawings, in which.

DETAILED DESCRIPTION

According to various embodiments, the control device determines the individual pass reductions in such a way that the individual pass reduction of the main rolling stand arranged directly upstream of the coiler is zero. Furthermore, the control device controls the main rolling stand arranged directly upstream of the coiler in such a way that—with respect to this main rolling stand—the tension in the strip on the outlet side is less than the tension on the inlet side, but the strip runs through this main rolling stand without undergoing forming, at least on one side.

The strip may have any desired strip width, for example be a wide strip (strip width 1200 mm and more). Generally, however, it is a narrow strip (width 800 mm and less). Often the strip is obtained by dividing a wide strip (for example a wide strip of 1500 mm in width is divided into two narrow strips each of 750 mm in width). In particular in this case, the strip often already has a wedge profile before the rolling in the rolling train.

The control device preferably activates the main rolling stand arranged directly upstream of the coiler in such a way that the strip runs through this main rolling stand without undergoing forming over its entire width. In the case of strips with a uniform, or at least symmetrical, width variation—as seen over the strip width—this is quite possible. However, the last-mentioned procedure is also desirable if the strip has a wedge profile. In this case, for example, the work rolls of the main rolling stand concerned may be pivoted with respect to one another—as seen in the strip running direction—and/or be set in a wedge profile—as seen in the strip thickness direction.

The strip should also run out straight from the main rolling stand arranged directly upstream of the coiler. The straight running-out from this main rolling stand is particularly important here for as long as the coiler has not yet engaged the strip. The correct running direction of the strip can also be achieved by appropriately pivoting the work rolls of the main rolling stand concerned with respect to one another or setting them in a wedge profile.

The strip often consists of steel. Steel can be alternatively cold-rolled or hot-rolled. In some cases the present invention may be used in the case of hot rolling. Generally, however, the strip is cold-rolled in the rolling train.

In principle, there may be any number of main rolling stands. As a minimum, there are two. The number generally lies between four and seven.

The control device preferably controls the main rolling stand arranged directly upstream of the coiler in such a way as to regulate the rolling force. In this case, the control device determines a desired rolling force of this main rolling stand in such a way that the strip runs through this main rolling stand without undergoing forming.

Figure 1:
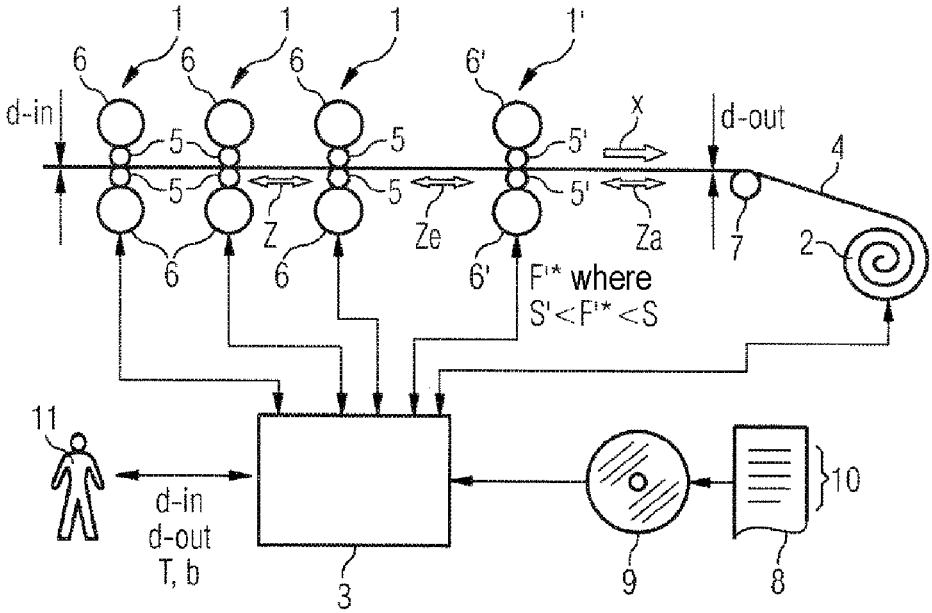
FIG. 1 shows a rolling train with main rolling stands, a coiler and a control device.

According to FIG. 1, a rolling train according to various embodiments has a number of main rolling stands 1, 1', a coiler 2 and a control device 3. A strip 4 runs through the main rolling stands 1, 1' one after the other and is then coiled up by the coiler 2. The control device 3 controls the main rolling stands 1, 1' and the coiler.

The number of main rolling stands 1,' is generally four to seven. As a minimum, there are two. The main rolling stands 1, 1' are generally (also see FIG. 1) formed as four-high stands. They therefore respectively have work rolls 5, 5' and backing rolls 6, 6'. Alternatively, they may additionally have further rolls, for example, in the case where they are formed as six-high stands, intermediate rolls.

The coiler 2 is arranged directly downstream of the last main rolling stand 1'. The term "directly downstream" means in this case that between the last main rolling stand 1' and the coiler 2 there is no element with which a tension Z prevailing in the strip 4 can be influenced to any appreciable extent.

However, one or more deflecting rollers 7 may be arranged between the last main rolling stand 1' and the coiler 2.

The last main rolling stand 1' is of particular significance within the scope of the present invention. For this reason, by contrast with the other main rolling stands 1, it has been provided with a reference numeral of its own, namely the reference numeral 1'. Where they relate specifically to the last main rolling stand 1', other numbers have also been provided hereafter with an apostrophe. The distinction does not have any further significance.

Figure 2:
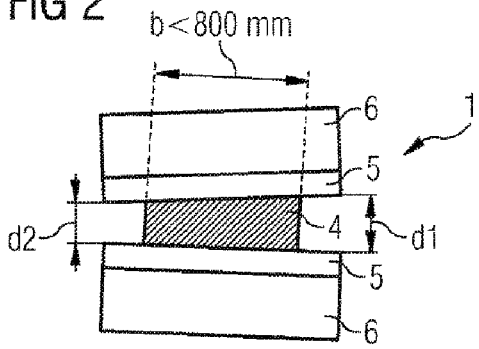
FIG. 2 shows a main rolling stand and a strip, as seen in the strip running direction.

The strip 4 that is rolled in the rolling train is generally a metal strip, for example a steel strip. The strip 4 may be a strip 4 of any desired width b, for example wide strip, that is to say a strip 4 which has a strip width b of at least 1200 mm. Generally, however, the strip 4 according to FIG. 2 is a narrow strip, the strip width b of which is at most 800 mm. Mostly, the strip width b is even below 600 mm, or below 700 mm.

In particular in the case of narrow strip, the strip 4 may already have a wedge profile before the rolling in the rolling train. It is therefore possible that the strip 4 has a greater strip thickness d1 on one side than on the other side, where it has a smaller strip thickness d2. The representation in FIG. 2 is exaggerated in this respect.

The strip 4 is generally cold-rolled in the rolling train. In individual instances, however, hot rolling is likewise possible.

As already mentioned, the control device 3 controls the main rolling stands 1, 1' and the coiler 2. The term "control" is to be understood here as meaning in the broad sense, i.e. in the sense of influencing the operating state of the rolling train. On the other hand, the term "control" is not to be understood as in contrast to the term "regulate".

The control device 3 comprises basic automation (i.e. simple controllers, for example for rolling speeds, roll nips, rolling forces, etc.) and a higher-level master control system. The higher-level master control system is what matters as far as the present invention is concerned.

The control device 3 is generally formed as a software-programmable device. A control program 8 is fed to it. The feeding of the control program 8 may take place, for example, by way of a network link (LAN, Internet, . . . ) or by way of a data carrier 9, on which the control program 8 is stored. A CD-ROM (see FIG. 1), a USB memory stick or a memory card come into consideration, for example, as the data carrier 9.

The control program 8 comprises machine code 10, that is to say program instructions which can be executed directly and indirectly by the control device 3. The control program 8 may be retrieved in the usual way (mouse click, etc.)—for example by an operator 11 of the rolling train. On the basis of the retrieval, it is executed by the control device 3. The execution of the control program 8 by the control device 3 has the effect that the control device 3 operates the rolling train according to an operating method which is explained in more detail below in conjunction with FIG. 3.

Figure 3:
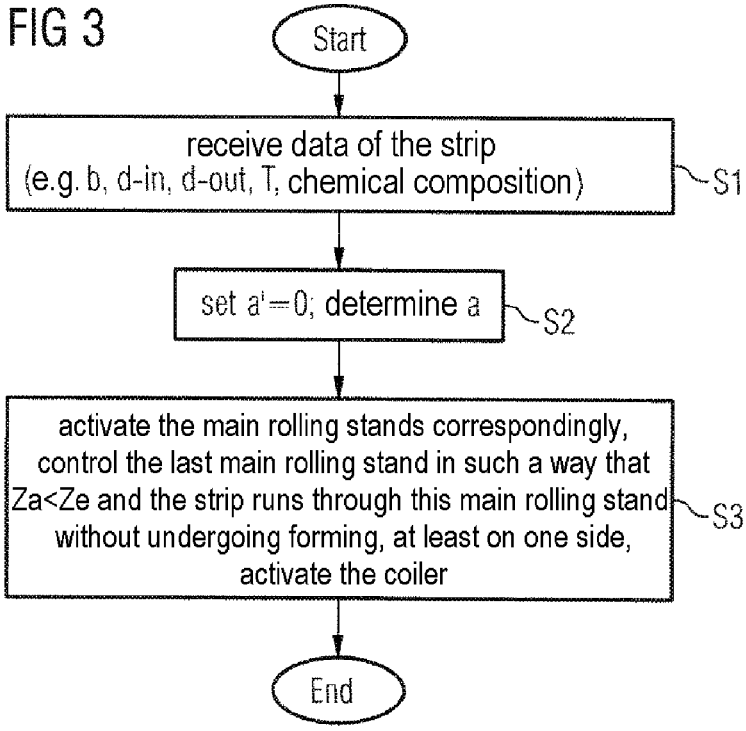
FIG. 3 shows a flow diagram.

According to FIG. 3, in a step S1, the control device 3 receives data of the strip 4, which is fed to the control device 3. The data comprise, for example, information concerning the strip width b, the initial strip thickness d-in, a desired end thickness d-out, an initial temperature T and a chemical composition of the strip 4. In particular, the data fed to the control device 3 implicitly or explicitly determine an overall pass reduction A, by which the initial thickness d-in of the strip 4 is to be reduced in the rolling train. The overall pass reduction A is—of course—greater than zero. The overall pass reduction A, the initial strip thickness d-in and the desired end thickness d-out are linked to one another here according to the relationship $$A = 1 - \frac{d\text{-out}}{d\text{-in}}.$$

In a step S2, the control device 3 determines, on the basis of the data fed to it, d-in, d-out, b and T, individual pass reductions a, a' for the main rolling stands 1, 1'. The individual pass reductions a, a' are defined here analogously with the overall pass reduction A, although the entry and exit thicknesses relate to the respective main rolling stand 1, 1'. The individual pass reductions a, a' are of course determined by the control device 3 within step S2 in such a way that they correspond altogether to the overall pass reduction A.

According to various embodiments, the control device 3 sets the individual pass reduction a' for the last main rolling stand 1' to the value zero. This contrasts with so-called skin-pass rolling stands. This is so because in the case of skin-pass rolling stands the individual pass reduction a' of the last main rolling stand 1' may be relatively small (for example only 1%) but it is greater than zero.

The control device 3 determines the other individual pass reductions a within step S2 as and when required. In principle, the determination of the other individual pass reductions a takes place as though the last main rolling stand 1' were simply not there.

It is possible that step S2 is always executed in the way described above. It may alternatively be modified to the extent that the control device 3 first attempts to distribute the overall pass reduction A between the main rolling stands 1 with the exception of the last main rolling stand 1'. If this is possible, step S2 is executed in the way explained above. Otherwise, the strip 4 can only be properly rolled if the individual pass reduction a' of the last rolling stand 1' is greater than zero. In such a case, either the individual pass reduction a' may be chosen to be as small as possible or it is determined in the customary way.

In a step S3, the control device 3 activates the main rolling stands 1, 1' and the coiler 2. The activation takes place by the strip 4 being rolled in the main rolling stands 1, 1' in a way corresponding to the individual pass reductions a, a' determined and then coiled up by the coiler 2. The control device 3 controls the last main rolling stand 1' here in such a way that—with respect to the last main rolling stand 1'—the tension Za in the strip 4 on the outlet side is less than the tension Ze on the inlet side. However, the activation also takes place in such a way that the strip 4 runs through the last main rolling stand 1' without undergoing forming, at least on one side.

Figure 4:
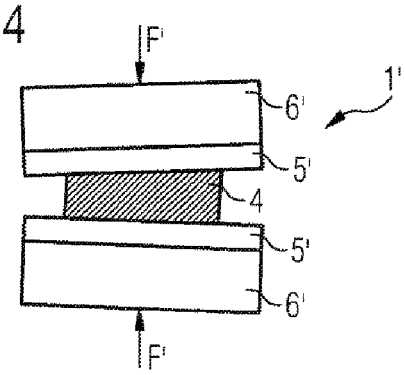
FIG. 4 shows the last main rolling stand, as seen in the strip running direction.
Figure 5:
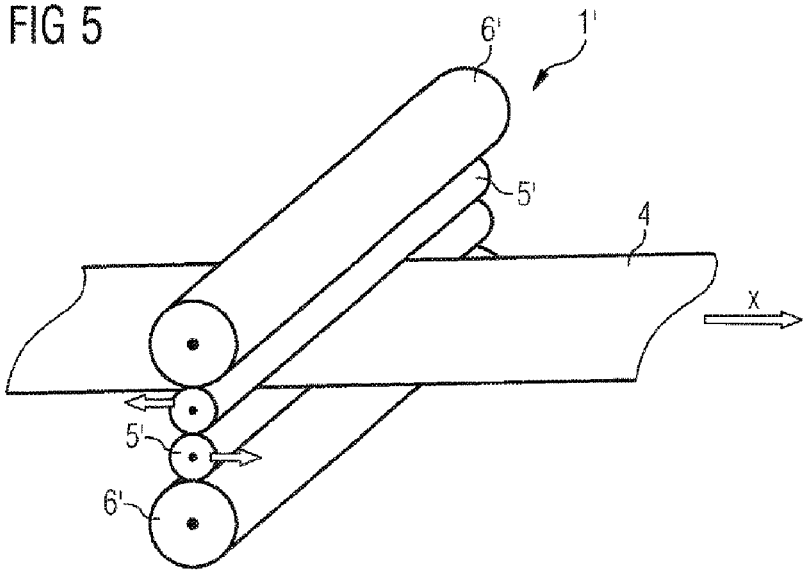
FIG. 5 shows the last rolling stand in a perspective representation.

The case where the strip 4 runs through the last main rolling stand 1' without undergoing forming only on one side, but not over its entire width b, may be necessary in individual instances if the strip 4 has a wedge profile. If, on the other hand, the strip 4 does not have a wedge profile, it is quite possible that the control device 3 activates the last rolling stand 1' in such a way that the strip 4 runs through the last main rolling stand 1' without undergoing forming over its entire width b (compare FIG. 4). This procedure is also preferred whenever the strip 4 has the wedge profile mentioned above. In order to achieve this state, it may be necessary—see FIG. 5—to activate the work rolls 5' of the last main rolling stand 1' by means of the control device 3 in such a way that the work rolls 5' are pivoted with respect to one another, as seen in the strip running direction x. Alternatively or in addition, the work rolls 5' may be set in a wedge profile, as seen in the strip thickness direction (see FIG. 4).

In order to achieve the effect that the strip 4 runs through the last rolling stand 1' without undergoing forming, a rolling force F' with which the last rolling stand 1' acts on the strip 4 must not be too great. The rolling force F' must therefore lie below an upper limit S. In order on the other hand to be able to achieve the effect that the tension Za on the outlet side is isolated from the tension Ze on the inlet side, the rolling force F' must lie above a lower limit S'. The control device 3 therefore preferably controls the last rolling stand 1' in such a way as to regulate the rolling force. The desired rolling force F'* for the last main rolling stand 1' is determined here by the control device 3 in such a way that it lies between the lower limit S' and the upper limit S.

The description above concerns stable operation of the rolling train in which the strip 4 is on the one hand rolled in the main rolling stands 1, 1' and is on the other hand coiled by the coiler 2. The description below concerns the case that occurs at the beginning of the rolling operation. The "beginning of the rolling operation" is meant here to mean the time period up to the time at which the coiler 2 engages the strip 4.

During the aforementioned time period it is possible that the strip 4 running out from the last main rolling stand 1' will stray to the side. In order to prevent such straying to the side, the control device 3 activates the last main rolling stand 1' correspondingly. In particular, the control device 3 may activate the last main rolling stand 1' in such a way that the work rolls 5' of this main rolling stand 1' are pivoted with respect to one another, as seen in the strip running direction x. Alternatively or in addition, it is possible that the control device 3 activates the last main rolling stand 1' in such a way that the work rolls 5' of this main rolling stand 1' form a wedge profile, as seen in the strip thickness direction. It is possible by one or both measures to bring about the effect that the strip 4 runs out straight from the last main rolling stand 1'.

The configurations according to various embodiment have many advantages. In particular, it is possible also to retrofit existing rolling trains in such a way that they can be operated in the way according to various embodiment, at least in most cases (that is to say whenever the overall pass reduction A is small enough).

The above description serves exclusively for explaining the present invention. On the other hand, the scope of protection of the present invention is to be determined exclusively by the appended claims.

What is claimed is:

1. An operating method for a rolling train for the rolling of a strip wherein the rolling train comprises a number of main rolling stands and a coiler arranged downstream of the main rolling stands, the main rolling stands respectively having work rolls and at least backing rolls, the method comprising the steps of:

feeding data of the strip, which establish at least an overall pass reduction other than zero by which an initial thickness of the strip is to be reduced in the rolling train, to a control device of the rolling train, determining by the control device individual pass reductions for the main rolling stands on the basis of the data fed to it, controlling by the control device the main rolling stands and the coiler in such a way that the strip is rolled in the main rolling stands in a way corresponding to the individual pass reductions determined and is then coiled up by the coiler, determining by the control device the individual pass reductions in such a way that the individual pass reduction of the main rolling stand arranged directly upstream of the coiler is zero, determining by the control device a rolling force for the main rolling stand arranged directly upstream of the coiler that both (a) lies above a lower limit to provide a tension on the outlet side of the particular main rolling stand that is isolated from, and lower than, a tension on the inlet side of the particular main rolling stand and (b) lies below an upper limit such that the strip runs through this main rolling stand without undergoing forming, and controlling the main rolling stand arranged directly upstream of the coiler based on the determined rolling force, and pivoting at least one work roll of the main rolling stand arranged directly upstream of the coiler such that the respective rotational axes of at least two work rolls of this main rolling stand are non-parallel to each another, such that the strip runs through this main rolling stand without undergoing forming.

2. The operating method according to claim 1, wherein the strip is a narrow strip.

3. The operating method according to claim 1, wherein the strip has a wedge profile before the rolling in the rolling train.

4. The operating method according to claim 1, wherein, at least at the beginning of the rolling of the strip, the control device activates the main rolling stand arranged directly upstream of the coiler in such a way that at least the work rolls of this main rolling stand are one of: pivoted with respect to one another, as seen in the strip running direction, and set in a wedge profile, as seen in the strip thickness direction, in such a way that the strip runs out straight from this main rolling stand.

5. The operating method according to claim 1, wherein the strip is cold-rolled in the rolling train.

6. The operating method according to claim 1, wherein the number of main rolling stands is at least four.

7. The operating method according to claim 1, wherein the strip is a metal strip.

8. A non-transitory computer readable medium storing a control program for a control device of a rolling train, wherein the rolling train has a number of main rolling stands and a coiler arranged downstream of the main rolling stands and the main rolling stands respectively having work rolls and at least backing rolls, the control program comprising machine code which, when executed by the control device, is operable to: determine individual pass reductions for the main rolling stands on the basis of data establishing at least an overall pass reduction other than zero by which an initial thickness of the strip is to be reduced in the rolling train, control the main rolling stands and the coiler in such a way that the strip is rolled in the main rolling stands in a way corresponding to the individual pass reductions determined and is then coiled up by the coiler, determine the individual pass reductions in such a way that the individual pass reduction of the main rolling stand arranged directly upstream of the coiler is zero, determine a rolling force for the main rolling stand arranged directly upstream of the coiler that both (a) lies above a lower limit to provide a tension on the outlet side of the particular main rolling stand that is isolated from, and lower than, a tension on the inlet side of the particular main rolling stand and (b) lies below an upper limit such that the strip runs through this main rolling stand without undergoing forming, and control the main rolling stand arranged directly upstream of the coiler based on the determined rolling force, and pivot at least one work roll of the main rolling stand arranged directly upstream of the coiler such that the respective rotational axes of at least two work rolls of this main rolling stand are non-parallel to each another, such that the strip runs through this main rolling stand without undergoing forming.

9. A control device for a rolling train, the rolling train comprising a number of main rolling stands and a coiler arranged downstream of the main rolling stands and the main rolling stands respectively having work rolls and at least backing rolls, the control device being operable to:

determine individual pass reductions for the main rolling stands to determine the individual pass reductions such that the individual pass reduction of the main rolling stand arranged directly upstream of the coiler is zero, control the main rolling stands and the coiler in such a way that the strip is rolled in the main rolling stands in a way corresponding to the individual pass reductions determined and is then coiled up by the coiler, and determine a rolling force for the main rolling stand arranged directly upstream of the coiler that both (a) lies above a lower limit to provide a tension on the outlet side of the particular main rolling stand that is isolated from, and lower than, a tension on the inlet side of the particular main rolling stand and (b) lies below an upper limit such that the strip runs through this main rolling stand without undergoing forming, and control the main rolling stand arranged directly upstream of the coiler based on the determined rolling force, and pivot at least one work roll of the main rolling stand arranged directly upstream of the coiler such that the respective rotational axes of at least two work rolls of this main rolling stand are non-parallel to each another, such that the strip runs through this main rolling stand without undergoing forming.

10. The control device as claimed in claim 9, wherein the strip is a narrow strip.

11. The control device as claimed in claim 9, wherein the strip has a wedge profile before the rolling in the rolling train.

12. The control device as claimed in claim 9, wherein, at least at the beginning of the rolling of the strip, the control device is operable to activate the main rolling stand arranged directly upstream of the coiler in such a way that at least the work rolls of this main rolling stand are at least one of pivoted with respect to one another, as seen in the strip running direction, and set in a wedge profile, as seen in the strip thickness direction, in such a way that the strip runs out straight from this main rolling stand.

13. The control device as claimed in claim 9, wherein the strip is cold-rolled in the rolling train.

14. The control device as claimed in claim 9, wherein the number of main rolling stands is at least four.

* * * * *